US005535649A

United States Patent [19]

Waggle, Jr.

[11] Patent Number: 5,535,649

[45] Date of Patent: Jul. 16, 1996

[54] LEVERAGE INCREASING EXTENDER ARM

[75] Inventor: Clinton R. Waggle, Jr., Akron, Ohio

[73] Assignee: Visionary Prototype Marketing Ltd., Fairlawn, Ohio

[21] Appl. No.: 395,891

[22] Filed: Feb. 28, 1995

[51] Int. Cl.[6] ..... B25G 3/24

[52] U.S. Cl. ..... 81/177.2

[58] Field of Search ..... 81/177.2, 177.1, 81/180.1, 184, 185.2, 427.5; 72/369

[56] References Cited

U.S. PATENT DOCUMENTS

| | | | |
|---|---|---|---|
| 905,650 | 12/1908 | Clarke et al. | 81/177.2 |
| 1,463,077 | 7/1923 | Gandell | 81/177.2 |
| 2,464,002 | 3/1949 | Snyder | 72/458 |
| 4,644,600 | 2/1987 | Fugate | 81/177.2 |

FOREIGN PATENT DOCUMENTS

| | | | |
|---|---|---|---|
| 107310 | 5/1939 | Australia | 72/459 |
| 308164 | 10/1918 | Germany | 81/177.2 |

*Primary Examiner*—Willis Little
*Attorney, Agent, or Firm*—Roger D. Emerson

[57] ABSTRACT

An implement for temporarily extending the length of an associated hand tool in order to increase the leverage thereof. The implement is adjustable as to length, width, height and angle to maximize the increased leverage. An associated hand tool is held to the implement by an adjustable catch mechanism which cooperates with a grooved tool support to provide opposing contact sites when a force is applied to the distal end of the implement.

20 Claims, 7 Drawing Sheets

LEVERAGE INCREASING EXTENDER ARM

BACKGROUND OF THE INVENTION

1. Field of Invention

This invention pertains generally to the art of hand tool length extenders and more specifically to adjustable implements used to increase the leverage of associated hand tools.

2. Description of the Related Art

In the art, it is known that often a given hand tool is not sufficient to provide the leverage necessary to loosen a nut or other fastener. One way of increasing the leverage of an associated hand tool is to extend the length of the tool by attaching a breaker bar, extension device, or piece of pipe to the shank of the tool. Such implements are designed to extend the length of the hand tool in the same direction of its shank only. An example of one such extender bar is given in U.S. Pat. No. 1,643,027 to Morgan (1927). However, cramped working conditions may limit the use of such straight-line extender bars.

The types of extension bars known in the art are also limited as to the scope of tools upon which a single extender bar can operate. Some extender bars operate only with certain types of wrenches. In other cases, only tools having relatively straight flat shanks can be used with the extension bar.

The present invention overcomes the foregoing difficulties in a way which is simple and efficient, while providing better and more advantageous results.

SUMMARY OF THE INVENTION

In accordance with the present invention, a new and improved leverage increasing implement is provided.

More particularly, in accordance with the invention, a leverage increasing implement which is adjustable as to length, angle and associated tool width is provided.

According to one aspect of the invention, an implement for extending the length of an associated tool comprises a body, a tool support, a hand grip, and a catch mechanism for holding the tool to the implement.

According to another aspect of the invention, the body of the implement has at least one bore therein which defines an attachment site for the catch mechanism.

According to another aspect of the invention, the catch mechanism comprises an attachment member which extends through the bore of the body. The attachment member comprises a pin and a length adjusting member. The pin of the attachment member defines an axis about which the catch mechanism is rotatable, whereby the angle of the catch mechanism relative to the length extending implement may be adjusted.

According to another aspect of the invention, the catch mechanism comprises first and second opposed side plates which are floatably joined by a stop pin. The stop pin is formed of high strength material.

According to another aspect of the invention, the opposed side plates of the catch mechanism have first apertures therein which define a pin location. The pin of the attachment mechanism extends through the first apertures to attach the catch mechanism to the body. The distance between the side plates is set by a length adjusting member. In one embodiment of the invention, the pin comprises a plurality of openings therein and the length adjusting member is a pin keeper which is selectively positioned through one of the openings. In another embodiment of the invention, the pin comprises a threaded region and the length adjusting member is a nut which is moveable along the threaded region.

According to another aspect of the invention, the tool support is located at a first end of the body. The tool support comprises opposed side walls having a longitudinal groove between them. In one embodiment of the invention, each of the side walls have a convex edge and the groove between them is also convex, whereby each of the walls has a continuous height from the edge to the groove.

According to another aspect of the invention, the hand grip of the implement comprises a edge having rounded contours. The hand grip further comprises flat side walls which have a plurality of crossed grooves therein.

According to another aspect of the invention, an implement for increasing the leverage of an associated tool is provided. The implement comprises:

a body having a plurality of bores therein;

a tool support located at a first end of the body and having a longitudinal groove therein between opposed supporting side walls;

a catch mechanism for holding the associated tool to the implement, the catch mechanism being selectively attached to the body at one of the bores, the catch mechanism comprising an attachment member which defines an axis about which the catch mechanism is rotatable; and, a hand grip which is located at the second end of the body.

According to another aspect of the invention, a method for increasing the leverage of an associated hand tool using an implement is provided which comprises the steps of:

supporting an edge of the associated tool with a tool support;

attaching a catch mechanism to the implement;

adjusting the catch mechanism to hold the associated tool; and, apply a force to a distal end of the implement.

According to another aspect of the invention, the step of supporting an edge of the associated tool comprises placing a portion of the tool between opposed supporting walls of the tool support so that the edge rests in a groove defined by the walls.

According to another aspect of the invention, the step of attaching the catch mechanism to the implement comprises:

placing a distal end of the associated tool between opposing side plates of the catch mechanism;

placing the implement between the side plates;

aligning an aperture of each of the side plates with a bore in the implement; and, connecting the catch mechanism to the implement with an attachment member.

According to another aspect of the invention, the step of adjusting the catch mechanism to hold the associated tool comprises:

setting an angular relationship between the associated tool and the implement by rotating the catch mechanism about a pin; and, setting the distance between opposed side plates of the catch mechanism by moving a length adjusting member along the body of the pin.

According to another aspect of the invention, the catch mechanism comprises a joining means of high strength material, and the step of applying a force to a distal end of the implement comprises:

pushing the distal end of the implement in a first direction;

causing the tool support to push against the associated tool in a second direction; and, causing the joining means to push against the associated tool in the first direction, whereby the leverage of the associated tool is increased.

One advantage of the present invention is its adaptability to many variations in the associated tool design.

Another advantage of the present invention is its use in increasing the leverage of an associated tool at an oblique angle.

Another advantage of the present invention is the sparkless and corrosion resistant construction.

Another advantage of the present invention is its ability to be used as a pipe, rod or tubing bender.

Another advantage of the present invention is its inherent safety features.

Another advantage of the present invention is its simplicity in assemblage and use.

Still other benefits and advantages of the invention will become apparent to those skilled in the art upon a reading and understanding of the following specification.

BRIEF DESCRIPTION OF THE DRAWINGS

The invention may take physical form in certain parts and arrangement of parts. A preferred embodiment of these parts will be discussed in detail in the specification and illustrated in the accompanying drawings which form a part of this disclosure and wherein.

DESCRIPTION OF THE PREFERRED EMBODIMENT

Figure 1:
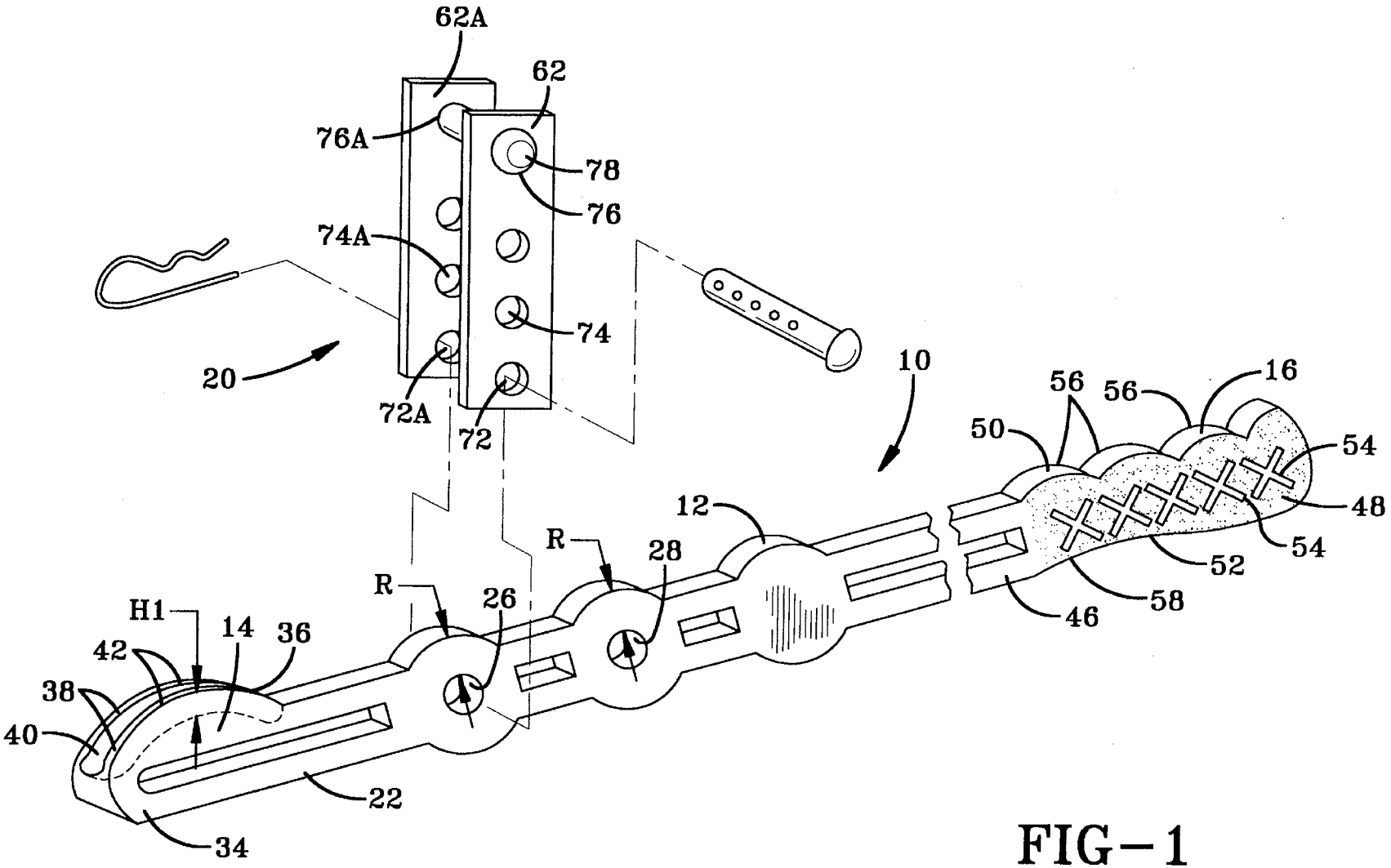
FIG. 1 is a perspective view of a leverage-increasing extender arm according to the invention showing a detached catch mechanism.

Referring now to the drawings, FIG. 1 shows a leverage-increasing extender arm 10 according to the invention. The extender arm comprises a body 12, a tool support 14, a hand grip 16 and a catch mechanism generally referred to as 20. The catch mechanism 20 is shown in a detached position. When the extender arm 10 is used, the catch mechanism 20 is attached to the body 12 as will be explained later in this disclosure. In a preferred embodiment, the body is bar-like, having flat sides 22. Extending between the flat sides 22 is a plurality of bores 26,28. The bores 26,28 define attachment points for the catch mechanism 20. Therefore, the catch mechanism 20 can be selectively attached to the body 12 at attachment site bore 26 or 28. In a preferred embodiment of the invention, each of the bores 26,28 have equal wall radius thicknesses R1 for added strength. Also in the preferred embodiment, the body 12 is made of a permanent mold casting for strength and durability. The material used to form the body 12 should be sparkless and corrosion resistant for application in a wide variety of environments.

Located at a first end 34 of the body 12 is a tool support 14. The tool support 14 comprises a protrusion 36. In a preferred embodiment of the invention, the protrusion 36 has opposed side walls 38, which define a longitudinal groove 40 therebetween. The side walls 38 may encompass a variety of shapes. In a preferred embodiment, each of the side walls 38 comprises a top edge 42 having a convex radius. The groove 40 has a similar convex radius whereby each of the walls 38 has a continuous height HI from the groove 40 to the top edge 42. The combination of the radiused edges 42 and the radiused groove 40 serves as a safety feature especially when the extender arm 10 is used on a tool at an oblique angle as will be explained more fully later in this disclosure. In a preferred embodiment of the invention, the tool support 14 is integral with the body 12.

A hand grip 16 is located at the second end 46 of the body 12. The hand grip 16 comprises opposed flat sides 48 and first and second edges 50,52 respectively. In a preferred embodiment of the invention, the sides 48 have roughened surfaces with crossed grooves 54 therein to provide slip resistant handling. The first edge 50 comprises a plurality of rounded contours 56 to provide holding sites for the user's fingers. The second edge 52 comprises a contour 58 to accommodate the shape of the user's hand near the thumb joint.

Still with reference to FIG. 1, one embodiment of the catch mechanism 20 is shown. In this embodiment, the catch mechanism 20 comprises first and second opposed side plates 62,62A respectively. Apertures 72,72A and 74,74A extending through the side plates 62,62A define pin locations. Also extending through the side plates 62,62A are apertures 76,76A. Joining means 78 for floatably joining the side plates 62,62A extends through apertures 76,76A. In a preferred embodiment, the joining means 78 is a stop pin of sufficient length to allow the side plates 62,62A to be separated a distance necessary to accommodate the shank of an associated tool.

Figure 2:
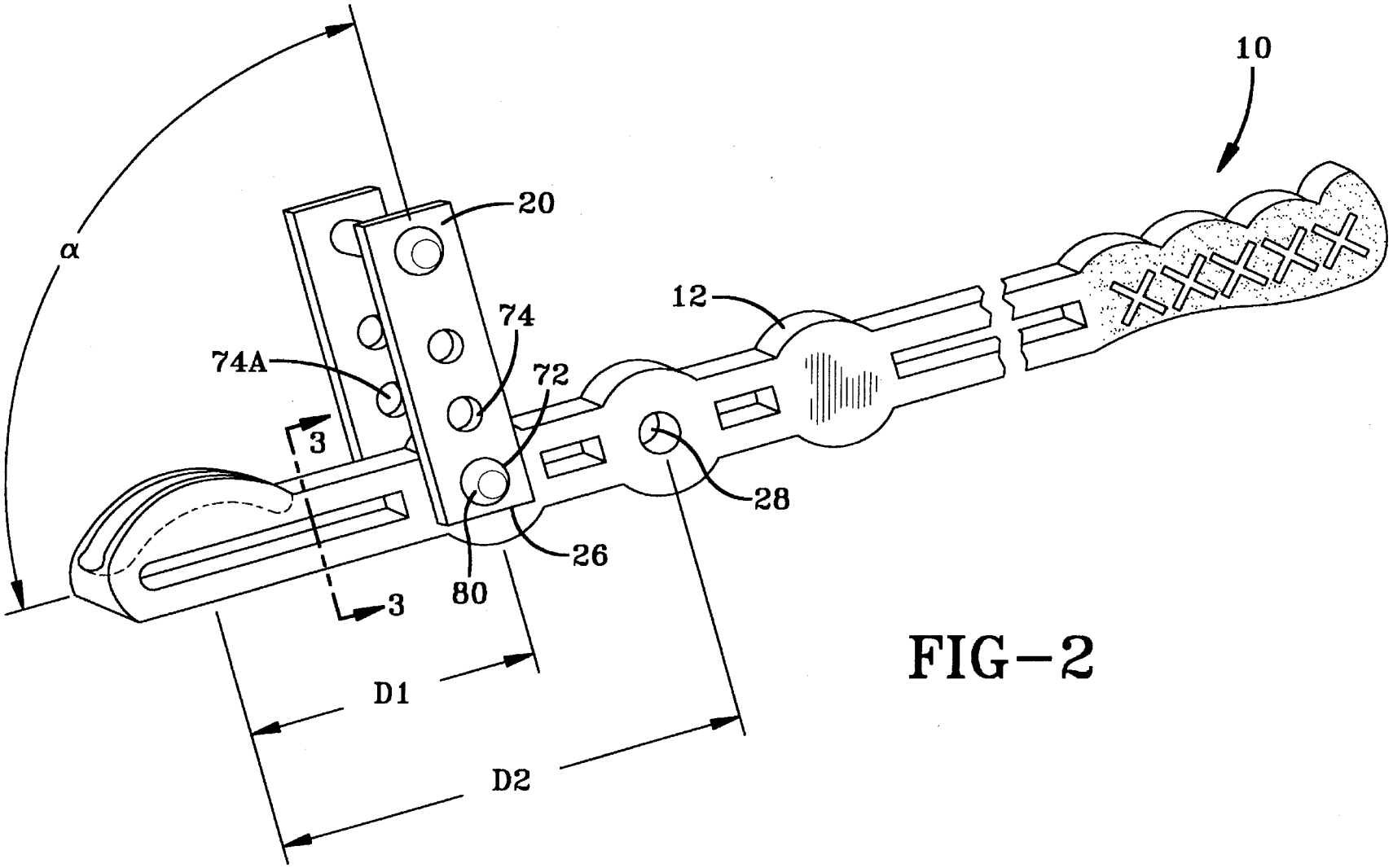
FIG. 2 is a perspective view of one embodiment of the invention showing an attached catch mechanism.

FIG. 2 shows one embodiment of the invention having an attached catch mechanism 20. The catch mechanism 20 comprises an attachment member 80. The catch mechanism 20 is selectively attached to the body 12 at an attachment site bore 26 by the attachment member 80. The attachment member 80 is also selectively located at pin location apertures 72,72A. In a preferred embodiment of the invention, the attachment member 80 defines an axis about which the catch mechanism 20 is rotatable. FIG. 2 shows an embodiment of the invention wherein the catch mechanism 20 is located at a first attachment site bore 26 which is a first distance D1 from the tool support 14. The catch mechanism 20 could be located instead at a second attachment site bore 28 which is a second distance D2 from the tool support 14. Additionally, the attachment member 80 of FIG. 2 is located at apertures 72,72A, but the attachment member 80 could be located at apertures 74,74A. Likewise, the angle $\alpha$ that the catch mechanism 20 makes with the body 12 can be adjusted. The choice of attachment site bore, 26 or 28, pin location apertures 72,72A or 74,74A, and angle $\alpha$ depends upon the most advantageous configuration during use of the extender arm 10.

Figure 3A:
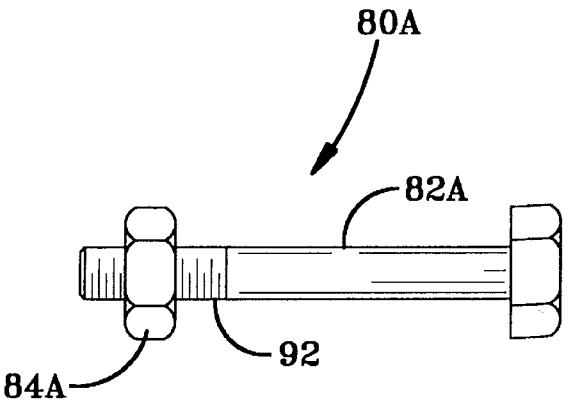
FIG. 3A shows an alternate embodiment of an attachment member according to the invention.
Figure 3:
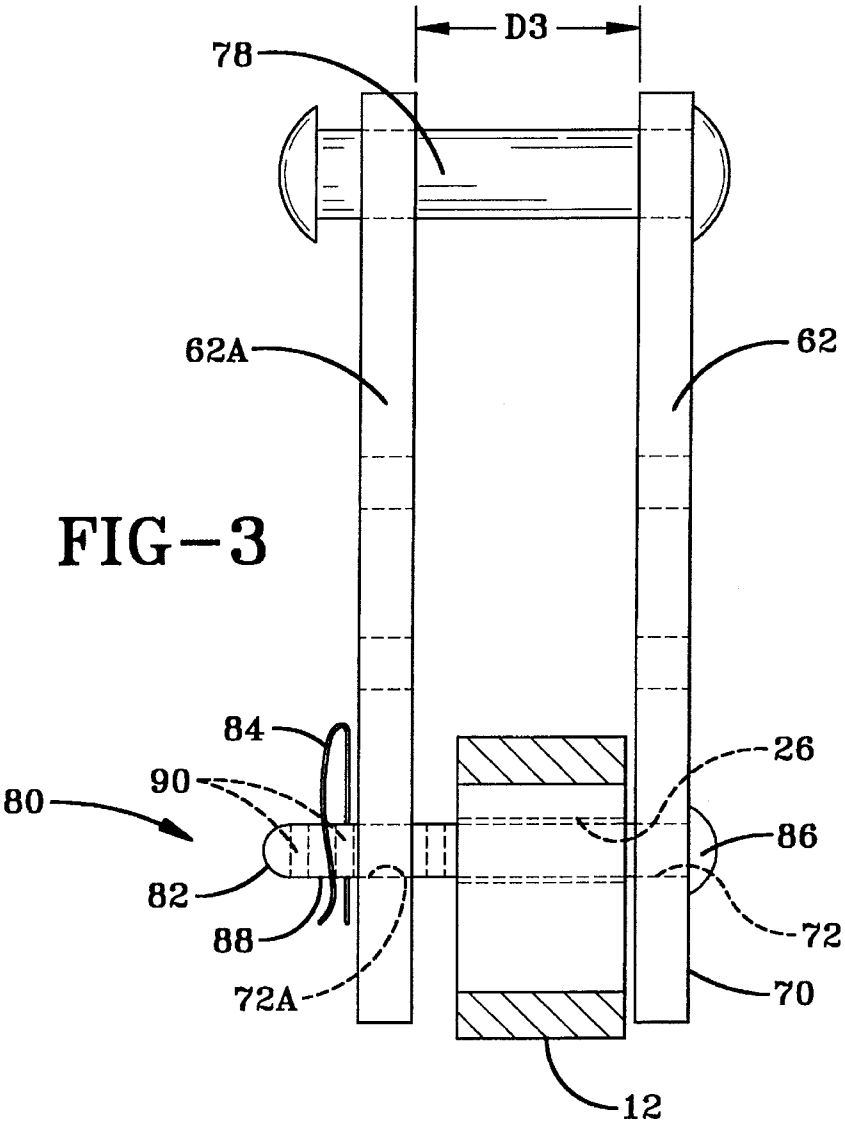
FIG. 3 is a sectional view of one embodiment of the invention taken along the line 3—3 of FIG. 2 showing an attached catch mechanism.

FIG. 3 is a sectional view of one embodiment of the invention taken along the line 3—3 of FIG. 2. The side plates 62,62A are moveable along the joining means 78 whereby the distance D3 between plates is changeable. The attachment member 80 comprises a pin 82 and a length adjusting member 84. The pin 82 comprises a head 86 and a body portion 88. The head 86 of the pin 82 is closely received to the outward surface 70 of the first side plate 62 and the body portion 88 extends through an aperture 72 of the first side plate 62, through the selected bore 26 of the body 12, and finally through an aperture 72A of the second side plate 62A. The length adjusting member 84 is positioned near the outward surface 70A of the second side plate 62A. The distance D3 between the side plates 62,62A is determined by the position of the length adjusting member 84 relative to the head 86 of the pin 82. In one embodiment of the invention, the body portion 88 has a plurality of openings 90 therein. The length adjusting member 84 is a pin keeper which is selectively placed within one of the openings 90. In FIG. 3A, an alternate attachment member 80A is shown. The pin 82A is a bolt having a threaded region 92. The length adjusting member 84A is a nut which is moveable along the threaded region 92.

Figure 4:
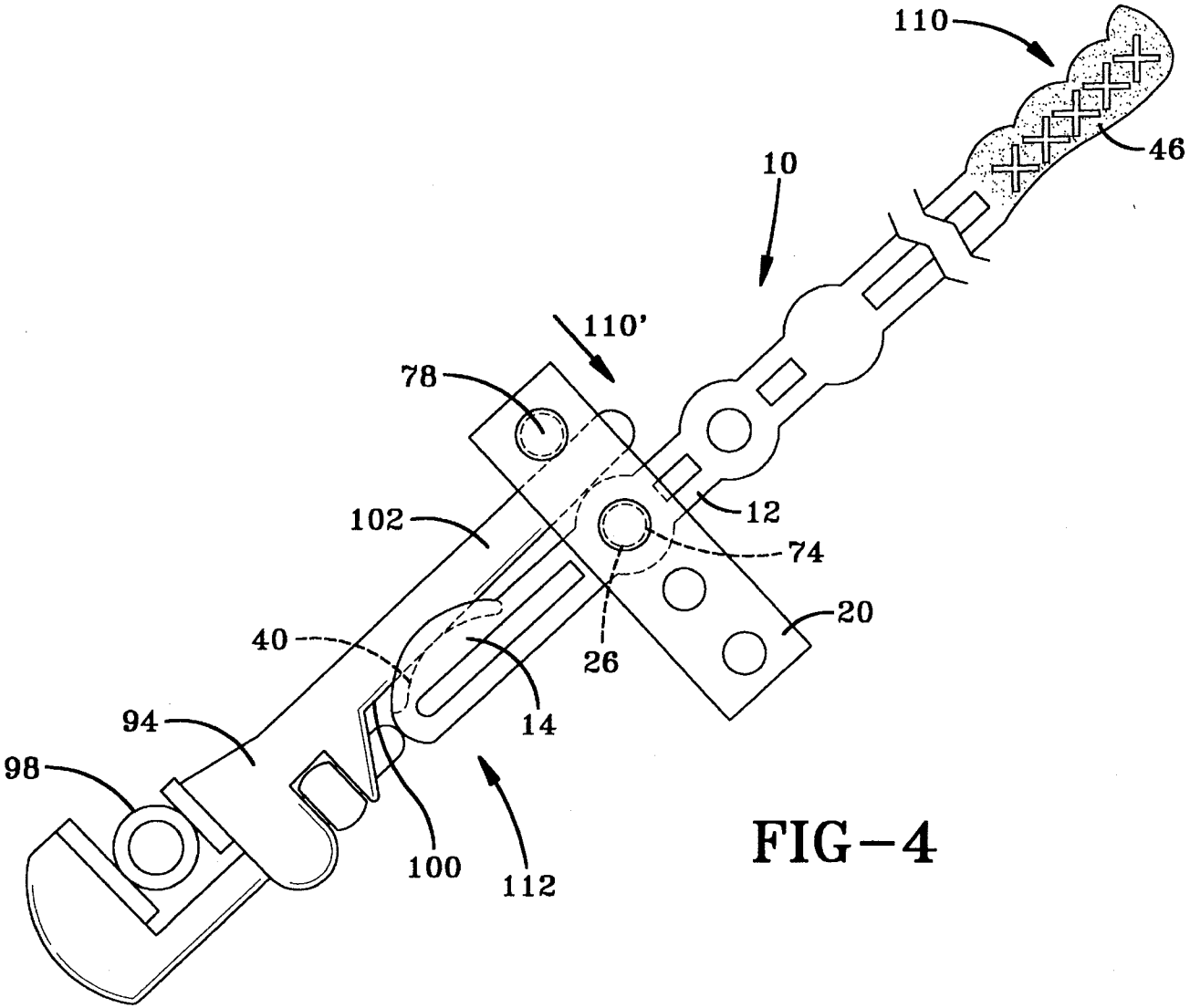
FIG. 4 is a side view of one embodiment of the invention with an associated tool.
Figure 5:
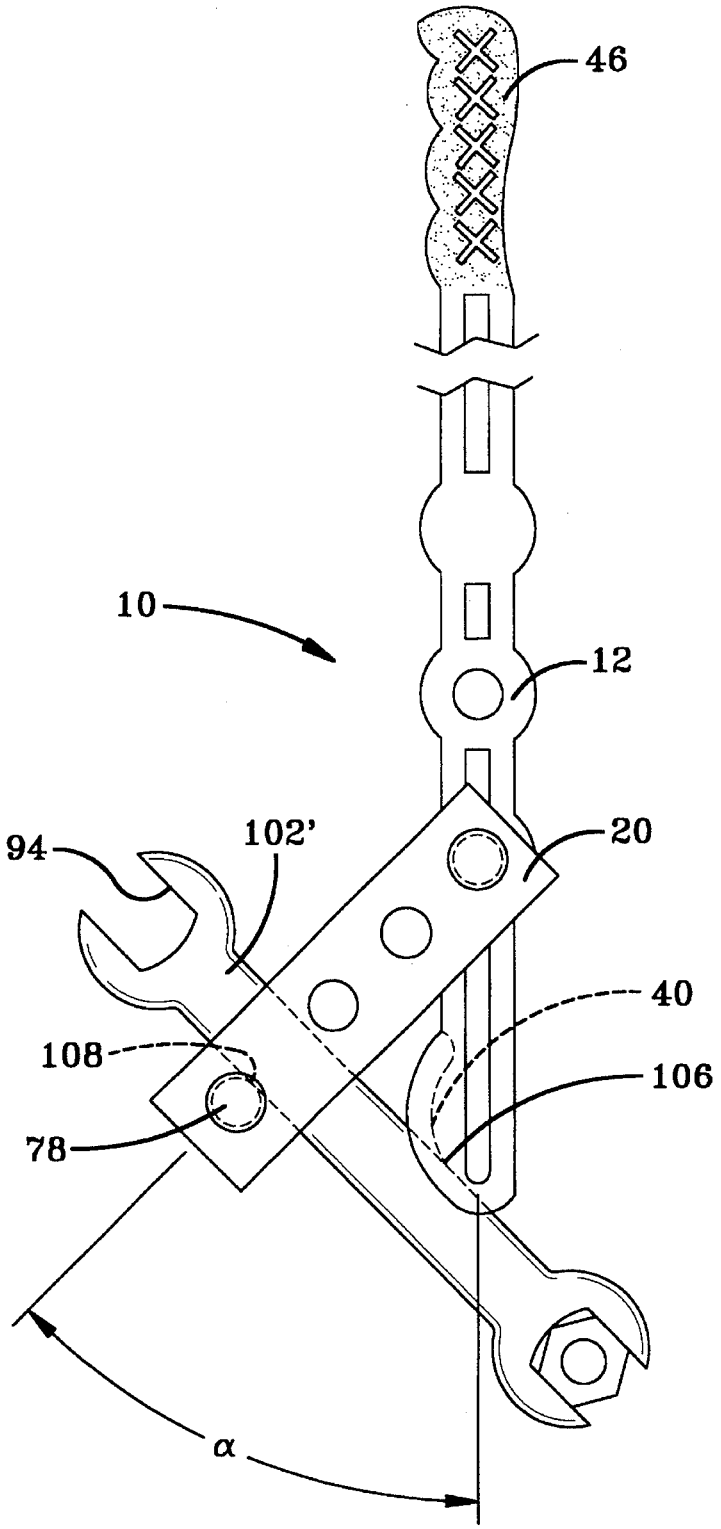
FIG. 5 is a side view of one embodiment of the invention showing an angular relationship between the extender arm and the shank of the associated tool.

Referring now to FIGS. 4 and 5, the use of the invention with an associated tool 94 is shown. In FIG. 4, the associated tool 94 is a pipe wrench. In order to increase the leverage of the associated tool 94 against a pipe 98, the extender arm 10 of the invention is utilized. An edge 100 of the associated tool 94 is placed within the groove 40 of the tool support 14. The shank 102 of the associated tool 94 extends along the body 12 and is held to the extender arm 10 by the catch mechanism 20. The attachment site bore 26 and the pin location apertures 74,74A are chosen, as well as the angle $\alpha$ (in this case 90°), to provide the most advantageous configuration. Next, the distance between side plates 62,62A is determined by setting the minimum distance allowable by the width of the shank 102 of the associated tool 94 (not shown). A force is applied at the second end 46 of the body 12 in a first direction 110. That force causes the tool support 14 to push against the associated tool 94 in an opposing direction 112. The shank 102 of the associated tool 94 is acted upon by the joining means 78 with an associated force in the direction 110' whereby the leverage of the associated tool 94 is increased.

As shown in FIG. 5, the leverage of an associated tool 94', in this case an open-ended wrench, can be increased even if the shank 102' of the associated tool 94' is held with the catch mechanism 20 set at an oblique angle $\alpha$ to the body 12 of the extender arm 10. In the preferred embodiment, the groove 40 is radiused and provides a first contact point 106 for the associated tool 94'. The opposing contact point 108 is still the joining means 78 so a force applied to the second end 46 of the extender arm 10 will increase the leverage of the associated tool 94'.

Figure 6:
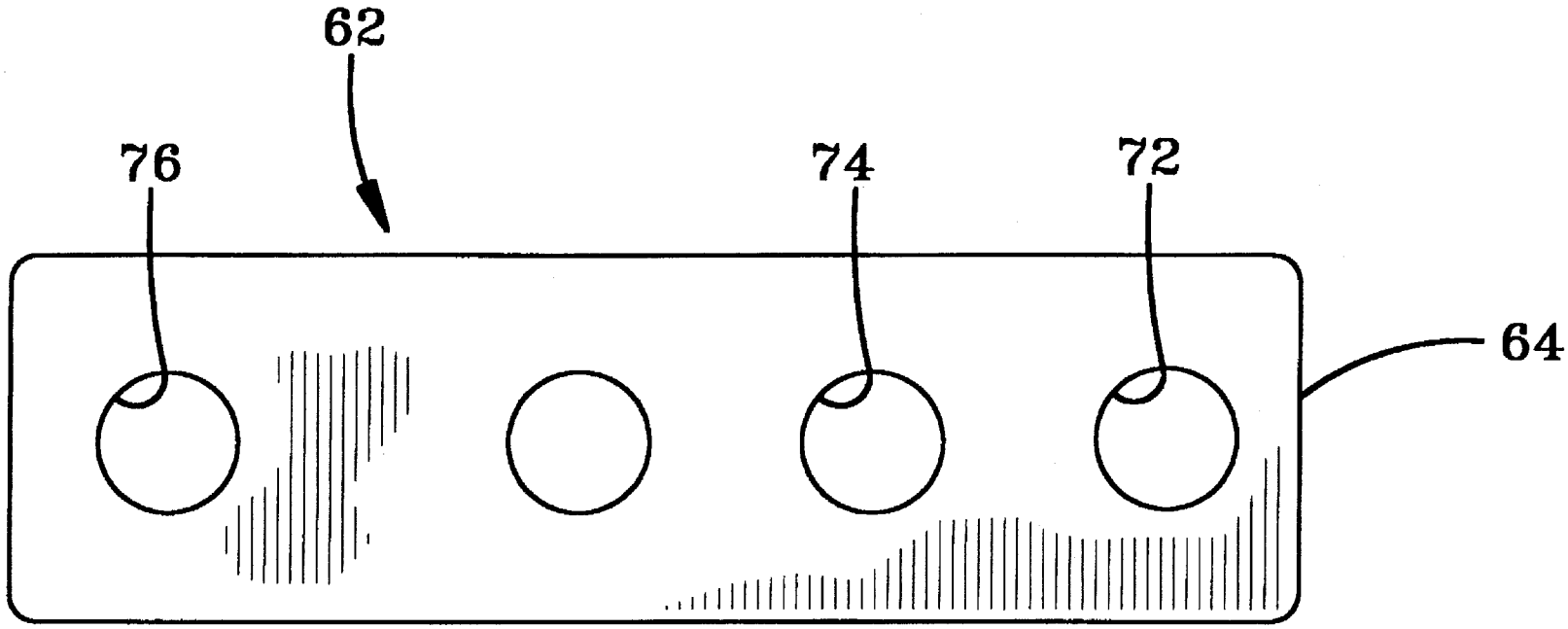
FIG. 6 is a front view of one embodiment of a side plate according to the invention.

In FIG. 6, a front view of one embodiment of a side plate 62 is given. The invention embodies two such plates which are essentially identical. In a preferred embodiment, the plate 62 has at least first, second and third apertures 72,74,76 respectively therein. The aperture 76 which is located farthest from the first end 64 receives the joining means of the catch mechanism. The remaining apertures 72,74 define pin locations at which an attachment member selectively connects the catch mechanism to the body.

Figure 7:
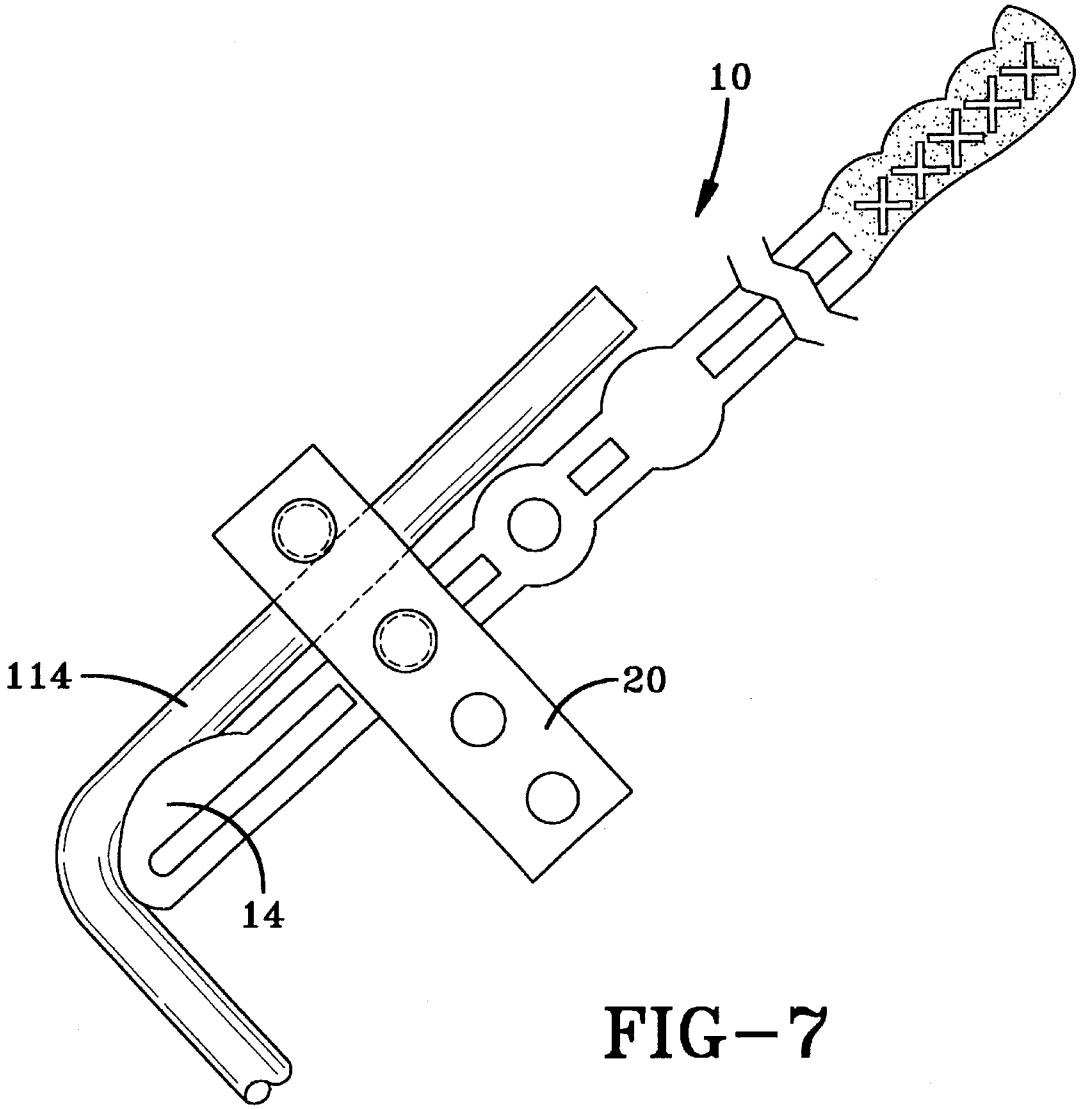
FIG. 7 is a side view of another embodiment of the invention showing its use as a pipe, rod or tubing bender.

FIG. 7 shows the extender arm 10 being utilized as an independent tool. A length of pipe, rod or tube, referred to generally as 114 can be positioned within the tool support 14 and catch mechanism 20 in order to be bent.

The present invention has been described with reference to the preferred embodiment. Obviously, modifications and alterations will occur to others upon a reading and understanding of the specification. It is intended by the applicant to include all such modifications and alterations insofar as they come within the scope of the appended claims or the equivalents thereof.

Having thus described the invention, it is now claimed:

1. An implement for extending the length of an associated tool, said implement comprising:

an elongated body, said body having first and second spaced apart ends;

a tool support, said tool support located at said first end of said body;

a hand grip, said hand grip located at said second end of said body; and, a catch mechanism, located a first distance from said tool support, said catch mechanism having first and second opposing side plates and a joining member extending transversely between said plates at a distance spaced from said body for receiving a portion of said associated tool and holding said associated tool to said implement.

2. The implement of claim 1 wherein said body has a first bore therein, said bore defining a first attachment site, said catch mechanism being selectively located at said attachment site.

3. The implement of claim 2 wherein said catch mechanism further comprises:

an attachment member, said attachment member extending through aligned bores in said side plates and said bore of said body and defining an axis about which said catch mechanism is rotatable.

4. The implement of claim 3 wherein each of said plates has spaced apart first and second ends, inward and outward surfaces, and first and second apertures therein, said first apertures of said plates being an equivalent first distance from said first ends, said second apertures being an equivalent second distance from said first ends, said first apertures defining a pin location;

and wherein said joining means floatably join said plates and extend through said second apertures.

5. The implement of claim 4 wherein said joining means comprises a stop pin, said stop pin being formed of high strength material.

6. The implement of claim 4 wherein said attachment member comprises:

a pin, said pin being located at said pin location, said pin having a head and a body portion, said head being closely received to said outward surface of said first plate; and, a length adjusting member, said member being closely received to said outward surface of said second plate.

7. The implement of claim 6 wherein said body portion has a plurality of openings therein and wherein said length adjusting member is a pin keeper, said pin keeper selectively extending through one of said openings.

8. The implement of claim 6 wherein said body portion has a threaded region and wherein said length adjusting member is a nut, said nut being moveable along said threaded region.

9. The implement of claim 6 wherein said pin defines an axis about which said catch mechanism is rotatable.

10. The implement of claim 1 wherein said tool support comprises:

a protrusion, said protrusion having first and second opposed side walls, said walls defining a longitudinal groove therebetween.

11. The implement of claim 10 wherein said first and second walls each comprise a top edge, said edge having a convex radius, and wherein said groove has a similar convex radius whereby each of said walls has a continuous height from said groove to said top edge.

12. The implement of claim 1 wherein said hand grip comprises:

an edge, said edge having a plurality of rounded contours; and, flat side walls, said walls having a plurality of crossed grooves therein.

13. An implement for increasing the leverage of an associated tool, said implement comprising:

an elongated body, said body having first and second spaced apart ends, said body having a plurality of bores therein;

a tool support, said tool support located at said first end of said body, said tool support having a longitudinal groove therein, said groove defining opposed supporting walls;

a catch mechanism cooperating with said tool support for holding said associated tool to said implement, said catch mechanism comprising first and second opposing side plates, a joining member transversely extending between said plates, and an attachment member, said side plates being selectively attached to said body at one of said bores with said attachment member, said attachment member defining an axis about which said catch mechanism is rotatable; and, a hand grip, said hand grip located at said second end of said body.

14. The implement of claim 13 wherein said first and second opposed side plates are placed a distance apart to receive a portion of said tool therebetween each of said plates having spaced apart first and second ends and inward and outward surfaces, said first and second plates each having first, second, and third apertures therein, said first apertures of said first and second plates being an equivalent first distance from said first ends, said second apertures being an equivalent second distance from said first ends, said third apertures being an equivalent third distance from said first end, said first and second apertures defining first and second pin locations; and, said joining means extending through said third apertures to floatably join said plates.

15. The implement of claim 14 wherein said attachment means comprises:

a pin, said pin being selectively located at one of said pin locations, said pin having a head and a body portion, said head being closely received to said outward surface of said first plate; and, a length adjusting member, said member being closely received to said outer edge of said second plate.

16. A method for increasing the leverage of an associated hand tool using a length extending implement, said method comprising the steps of:

supporting an edge of said associated tool with a tool support;

attaching a catch mechanism to said implement, said catch mechanism having first and second opposing side plates, a joining member extending transversely between said plates, and an attachment member for attaching said plates to said implement, said side plates having an adjustable distance between said joining and attachment members;

adjusting said catch mechanism to receive and hold said associated tool; and, applying a force to a distal end of said implement.

17. The method of claim 16 wherein said step of supporting an edge of an associated tool comprises:

placing a portion of said associated tool between opposed supporting walls of said tool support so that said edge of said tool rests in a groove defined by said supporting walls.

18. The method of claim 16 wherein said implement has a bore therein and each of said plates has an aperture therein, and wherein said step of attaching said catch mechanism to said implement comprises:

placing a shank of said associated tool between said side plates;

placing said implement between said side plates;

aligning said apertures of said side plates with said bore of said implement; and, connecting said catch mechanism to said implement with an attachment member.

19. The method of claim 18 wherein said attachment member comprises a pin and a length adjusting member, said pin having a head, said head being outward of said first side plate and said length adjusting member being outward of said second side plate, and wherein said step of adjusting said catch mechanism to hold said associated tool comprises:

setting an angular relationship between said associated tool and said implement by rotating said catch mechanism about said pin; and, setting a distance between said side plates by placing said length adjusting member at a minimal distance from said head whereby said side plates are closely received to said associated tool.

20. The method of claim 19 wherein said joining means floatably join said side plates said joining means being outward of said associated tool and wherein the step of applying a force to said distal end of said implement comprises:

pushing said distal end of said implement in a first direction;

causing said tool support to push against said associated tool in a second direction; and, causing said joining means to push against said associated tool is said first direction;

whereby said leverage of said associated tool is increased.

* * * * *